United States Patent [19]

Newman et al.

[11] Patent Number: 4,624,119

[45] Date of Patent: Nov. 25, 1986

[54] TUMBLER LOCK

[75] Inventors: Donald J. Newman, Somerville; Gerald F. Dunphy, Glen Waverley, both of Australia

[73] Assignee: Ogden Industries Pty. Ltd., Victoria, Australia

[21] Appl. No.: 543,276

[22] Filed: Oct. 19, 1983

[30] Foreign Application Priority Data

Oct. 27, 1982 [AU] Australia ..... PF6545

[51] Int. Cl.[4] ..... E05B 29/02

[52] U.S. Cl. ..... 70/366; 70/360; 70/377

[58] Field of Search ..... 70/365, 366, 360, 362, 70/369, 377, 364 R

[56] References Cited

U.S. PATENT DOCUMENTS

| | | | |
|---|---|---|---|
| 688,070 | 12/1901 | Denn | 70/362 |
| 1,616,255 | 2/1927 | Douglas | 70/366 |
| 1,979,095 | 10/1934 | Braunig | 70/368 |
| 2,061,456 | 11/1936 | Falk | 70/368 X |
| 2,648,972 | 8/1953 | Diesel | 70/366 |
| 3,623,345 | 11/1971 | Solitanner | 70/366 |
| 3,709,006 | 1/1973 | Seidewand | 70/377 X |
| 4,083,212 | 4/1978 | Proefrock | 70/366 |
| 4,272,975 | 6/1981 | Patriquin | 70/369 |
| 4,317,347 | 3/1982 | Martikainen | 70/366 |
| 4,789,638 | 2/1974 | Roberts et al. | 70/366 |

FOREIGN PATENT DOCUMENTS

| | | | |
|---|---|---|---|
| 165562 | 4/1954 | Australia . | |
| 412722 | 12/1966 | Australia . | |
| 498983 | 4/1978 | Australia . | |
| 641072 | 8/1950 | United Kingdom . | |
| 2084237 | 4/1982 | United Kingdom . | |
| 2129045 | 5/1984 | United Kingdom | 70/365 |

OTHER PUBLICATIONS

Robinson, R. L., "Complete Course in Professional Locksmithing", Chapter 13, pp. 126 to 140 (The Disc Tumbler Lock Mechanism).

*Primary Examiner*—Robert L. Wolfe
*Assistant Examiner*—Russell W. Illich
*Attorney, Agent, or Firm*—Berman, Aisenberg & Platt

[57] ABSTRACT

A cylinder lock having a plurality of plate-like tumblers, each of which is carried by the lock barrel to rotate therewith and each being adapted to locate within a respective locking recess provided in the lock body and thereby hold the barrel against rotation relative to the body. The tumbler plates are movable laterally relative to the barrel axis so as to be capable of removal from their respective locking recesses and thereby free the barrel for rotation. A locking pin interconnects the tumbler plates so that they move in unison between their barrel locking and release positions, and a plurality of rotatable discs interacts with that pin to control its ability to move radially inwards and thereby free the tumbler plates from their locking recesses. Each disc has a peripheral notch which must be located adjacent the locking pin to allow the aforementioned radial inward movement.

14 Claims, 13 Drawing Figures

TUMBLER LOCK

This invention relates to tumbler locks and is particularly concerned with cylinder locks.

Cylinder locks include a body member of any external shape and having a cylindrical bore therein, and a barrel member rotatably mounted in that bore. Tumblers, which can be of any of several varieties, are operative to lock the barrel against rotation within the cylinder body and are releasable from that operative position by a correctly formed key inserted into a keyway of the lock.

Pin tumbler locks are in common use, but they suffer from a lack of security in that they can be "picked" with relative ease. Such locks form the subject of Australian patents Nos. 165,562 and 412,722. Disc tumbler locks are sometimes more secure and particularly those of the side-locking bar type in which plate-like tumblers or discs control the location of that bar in barrel lock and release positions respectively. Examples of such locks are disclosed by U.S. Pat. No. 3,789,638, U.K. Patent No. 641072 and Australian Patent No. 498,983. Picking of such locks can be difficult and resistance to forced rotation will generally be greater than in the case of pin tumbler locks. Such locks, however, are not so resistant to forced axial extraction of the barrel and furthermore it is possible to remove the side locking bar by drilling through the front face of the lock cylinder. Locks employing ball tumblers in place of the side locking bar are also susceptible to attack in the latter fashion.

It is a principal object of the present invention to provide a cylinder lock of improved security in that it has relatively high resistance to forced extraction and rotation of the barrel. It is a further object of the invention to provide such a lock which is difficult to pick or otherwise manipulate into a release condition without use of a correct key. Still another object of the invention is to provide such a lock which can be manufactured in relatively small dimensions. Other objects and advantages of the invention will become apparent from the following description of one possible form of the invention.

In accordance with the present invention, there is provided a cylinder lock including, a body having a cylindrical bore therein, a barrel mounted within said bore for rotation relative to said body, a plurality of tumbler plates carried by said barrel so as to rotate therewith and each being arranged generally transverse to the rotational axis of said barrel, a plurality of locking recesses formed in a surface of said bore, each said tumbler plate being movable laterally relative to said barrel to adopt either a barrel lock position or a barrel release position, and a peripheral portion of at least two of said tumbler plates engages within a respective one of said locking recesses when those plates are in the barrel lock position to thereby hold said barrel against rotation relative to said body and to also hold said barrel against axial separation from said body in at least one direction.

As stated in the preceding paragraph, the barrel is prevented from rotating relative to the lock body when the tumbler plates are in the barrel lock position. That is not to be understood as meaning that absolutely no amount of relative rotation can occur under the condition described. In fact, a small amount of relative rotation may be possible, but it is not sufficient to allow the barrel to perform a function such as release of a latch, as normally results from its rotation relative to the lock body. That is, the statement in question is to be read as meaning that the barrel is prevented from rotating to a degree sufficient for it to operate or release associated mechanism.

If there is more than two tumbler plates, it is preferred that each is engagable within its own individual locking recess provided in the cylinder body. It is also preferred that the tumbler plates move between the barrel lock and barrel release positions under the control of a plurality of rotatable or turnable discs. It is further preferred that the tumbler plates are interconnected for simultaneous movement between the barrel lock and release positions, but that is not essential. The discs may be of plate-like construction and can also be of any suitable peripheral shape and can be pivotally or otherwise mounted for relative rotation about an axis extending generally in the same direction as, but not necessarily coincident with, the axis of rotation of the barrel.

It will be convenient to hereinafter describe the invention with reference to a particular lock construction which has some of the characteristics of the lock according to Australian Patent Application No. 86467/82. The disclosure of that patent application is therefore to be understood as imported into the present specification by cross reference. In particular, the barrel assembly of the example lock includes a plurality of cam discs which are rotatable about an axis substantially coincident with the axis of rotation of the barrel assembly. Each disc has a substantially centre opening which forms part of the lock keyway and that opening is of non-circular shape so as to cooperate with a key in such a way that the disc can be positioned by the key as necessary to release the barrel for rotation relative to the cylinder.

The essential features of the invention, and further optional features, are described in detail in the following passages of the specification which refer to the accompanying drawings. The drawings however, are merely illustrative of how the invention might be put into effect, so that the specific form and arrangement of the features (whether they be essential or optional features) shown is not to be understood as limiting on the invention.

Figures 1, 2:
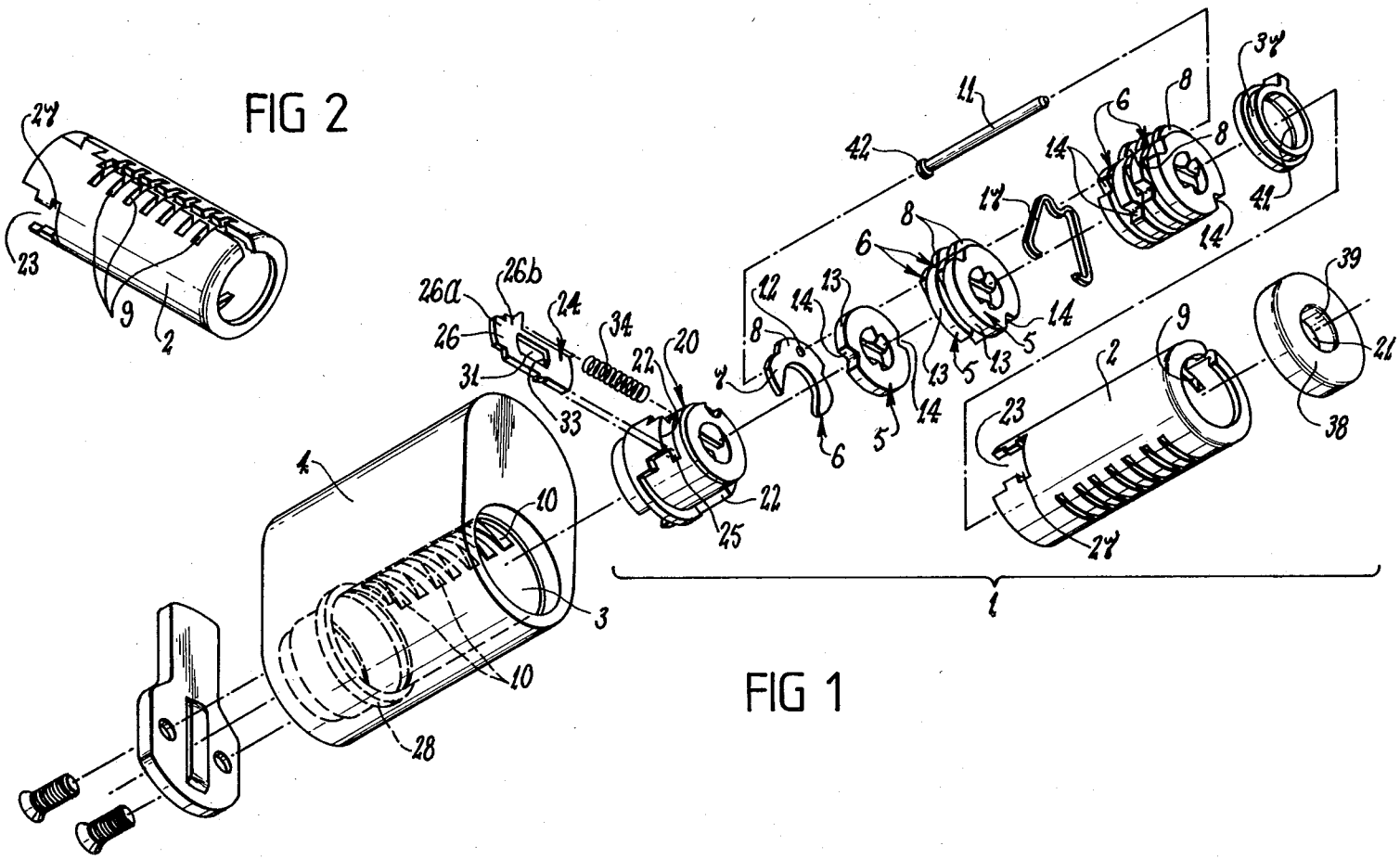
FIG. 1 is an exploded perspective view of one form of lock incorporating an embodiment of the invention.
FIG. 2 is a perspective view of the lock barrel cylinder shown in FIG. 1, but taken from a different angle.

In the example lock construction shown, a barrel assembly 1 includes a cylindrical sleeve 2 which is rotatably mounted within a cylindrical bore 3 of the lock body 4. Each of a plurality of cam discs 5 is rotatably located within the sleeve 2 and in the preferred arrangement shown, those discs 5 are capable of unrestrained rotation within the sleeve 2. That is, each cam disc 5 is free to rotate through 360° or more relative to the sleeve 2 and to the other cam discs 5. The sleeve 2 forms one of the active components of the assembly 1 in that rotation of the sleeve 2 is necessary to effect actuation of a latch or deadbolt for example (not shown), with which the lock is to be used. The axis of rotation of the sleeve 2 is preferably substantially coincident with the axis about which the cam discs 5 rotate relative to the sleeve 2.

A plurality of tumbler plates 6 is mounted within the sleeve 2 so that each has its broad surfaces generally transverse to the longitudinal axis of the sleeve 2. Each tumbler plate 6 has a body part 7 and a locking lobe 8 which projects laterally from the body part 7 and is slidably located within a respective slot 9 formed through the wall of the sleeve 2. Each lobe 8 is adapted to project through its respective slot 9 for location within a cooperative locking recess 10 provided in the surrounding surface of the cylinder bore 3. An individual recess 10 is provided for each tumbler plate 6 and each recess 10 cooperates with its respective locking lobe 8 in such a way that rotation of the sleeve 2 is prevented by such cooperation unless the respective tumbler plate 6 is able to move in a direction to extract the locking lobe 8 from the recess 10.

Figure 3:
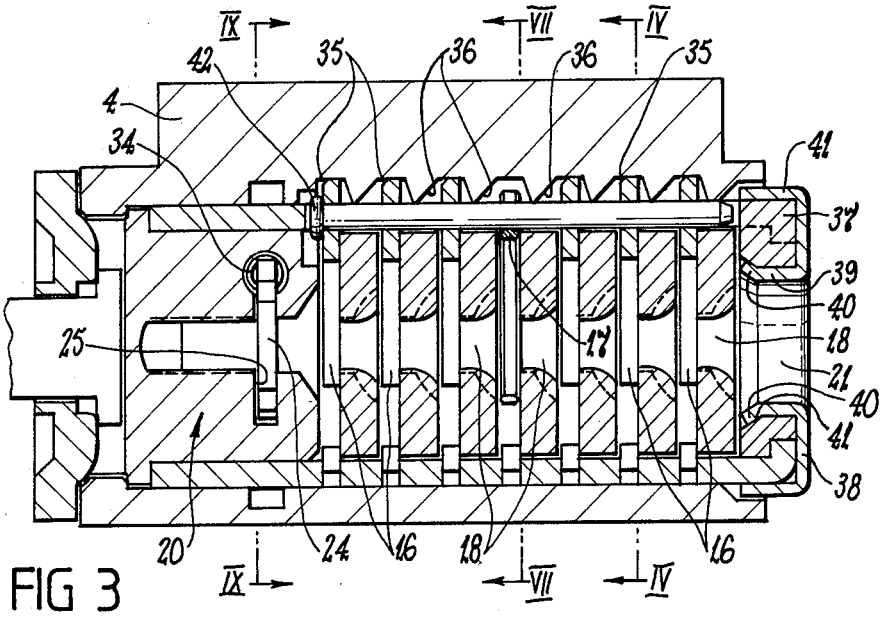
FIG. 3 is a longitudinal cross sectional view of the assembled lock of FIG. 1.
Figure 4:
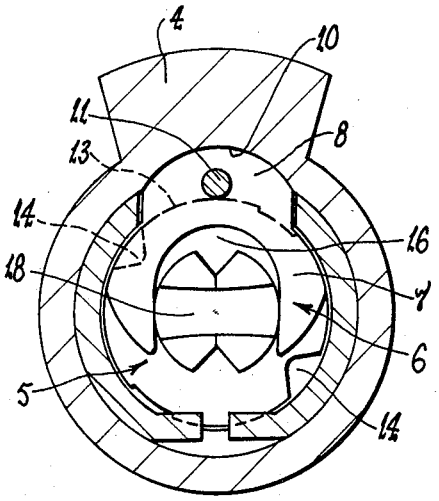
FIG. 4 is a transverse cross sectional view taken along line IV—IV of FIG. 3.
Figure 6:
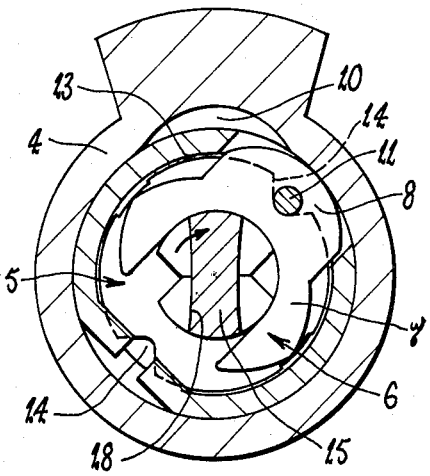
FIG. 6 is a view similar to FIG. 5 but showing the barrel assembly rotated a further distance and the tumbler plates released from the barrel lock position.

Each tumbler plate 6 is in a barrel lock position when its locking lobe 8 is within the associated locking recess 10 as shown in FIGS. 3 and 4. Means is provided for controlling the ability of the tumbler plate 6 to move clear of the recess 10 into a barrel release position as shown in FIG. 6. That control means includes the cam discs 5 and they are arranged so that every one must adopt a particular respective rotational position in order for all tumbler plates 6 to be able to move into the barrel release position. Preferably, as shown, all tumbler plates 6 are interconnected so that they move in unison between the barrel lock and release positions, but they can be arranged for independant movement if required.

In the preferred arrangement shown, a locking pin 11 interconnects the various tumbler plates 6 and is arranged to cooperate with the cam discs 5 to form part of the control means. The pin 11 conveniently extends in the axial direction of the barrel assembly 1 and passes through a hole 12 provided in each tumbler plate 6. With this arrangement, it is preferred that the tumbler plates 6 and cam discs 5 are alternately located in face to face relationship within the barrel sleeve 2 as best seen in FIG. 3. That is, a cam disc 5 intervenes between each two adjacent locking plates 6. The interconnecting pin 11 is located outside the periphery 13 of the cam discs 5 so that its ability to move radially inwards of the barrel assembly 1 is controlled by the cam disc peripheries 13.

Figure 5:
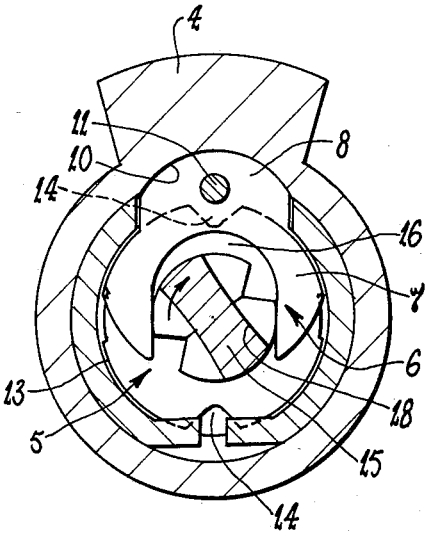
FIG. 5 is a view similar to FIG. 4, but showing the cam discs rotated by a key to a position at which the tumbler plates can be released from the barrel lock position.

It is preferred, as shown, that each cam disc 5 has at least one notch 14 provided in its periphery 13 which is adapted to receive a portion of the locking pin 11. When all of the notches 14 are aligned beneath the pin 11 as shown in FIG. 5, the locking pin 11 can move radially inwards of the barrel assembly 1 through a distance as permitted by the notches 14 and that movement is sufficient to place all of the tumbler plates 6 in the barrel release position (FIG. 6). The notches 14 are aligned when each cam disc 5 is in a rotational position hereinafter called its lock release position, and that position is established by use of a correct key 15 as hereinafter described. The tumbler plates 6 are unable to move to the barrel release position if any one of the cam discs 5 is not in its lock release position, or if the longitudinally aligned notches 14 are not in radial alignment with the locking pin 11.

Each tumbler plate 6 has a locking lobe 8 as previously described and, in the form shown, that lobe 8 projects laterally from the body 7 which may be of any suitable peripheral shape. An opening 16 for the passage of the key 15 is provided through each plate 6 and in the form shown that comprises a slot extending into the body 7 from the side edge thereof remote from the locking lobe 8. It is generally convenient to locate the hole 12 for the locking pin 11 adjacent to the locking lobe 8 as shown in FIG. 1.

Figure 7:
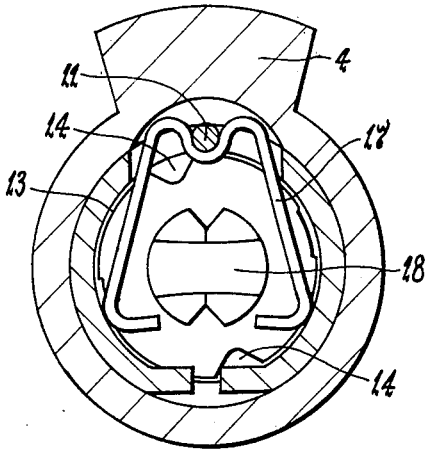
FIG. 7 is a transverse cross sectional view taken along line VII—VII of FIG. 3.

Each of the slots 9 in the sleeve 2 which slidably receives a locking lobe 8 has a length such as not to permit passage of the plate body 7. Each locking recess 10 may be a groove formed in the surface of the cylinder bore 3 and which progressively reduces in depth at each end portion to provide ramping surfaces which function as hereinafter described. At least one spring may act against the locking pin 11 and or one or more of the tumbler plates 6 to bias those plates 6 into the barrel lock position. Preferably, as shown in FIG. 7, a single U shaped spring 17 is located substantially midway along the tumbler plate 6/cam disc 5 assembly and acts between the locking pin 11 and the inside surface of the sleeve 2 to provide the desired bias. It is to be appreciated however, that such bias is not essential.

In the preferred construction shown, the keyway opening 18 of each cam disc 5 is substantially as described in Australian patent application No. 86467/82 and the cooperative key 15 is of the general form as also described in that patent application. The key blade (not shown) has a series of relatively twisted or angularly disposed portions arranged in longitudinally spaced relationship along the length of the blade. Each of those portions cooperates with a respective one of the disc openings 18 to hold that particular disc 5 at a particular position of rotation relative to each other disc 5, and when the key 15 has a particular position relative to the cylinder body 4 it holds all cam discs 5 at the respective lock release position.

Figure 8:
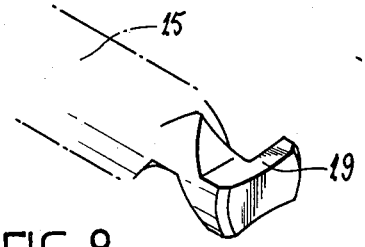
FIG. 8 is a perspective view of an end of a key usable with the lock of FIG. 1.

When the correct key 15 is fully inserted into the keyway 16,18 it preferably drivably engages the barrel assembly through means other than, or additional to, the cam discs 5 and tumbler plates 6. That is, turning movement of the key 15 is transmitted to the barrel assembly 1 through means other than the cam discs 5 and tumbler plates 6. That means may include a terminal end portion 19 (FIG. 8) of the key blade and an adaptor 20 (FIGS. 1 and 3) connected to the barrel sleeve 2 at the end thereof remote from the keyway entrance 21. Drive cooperation between the key 15 and the adaptor 20 however, may not be effected until the key 15 is approaching the fully inserted position.

Assuming the correct key 15 is employed, turning movement of the key 15 in either direction of rotation will cause corresponding movement of the barrel sleeve 2 through the key 15 and adaptor 20 connection. That will bring each locking lobe 8 into engagement with a ramping surface of the respective locking recess 10 so that continued turning movement of the key 15 will cause the tumbler plates 6 to be ramped inwards into the barrel release position (FIGS. 5 and 6). Such inward movement is possible because each disc 5 is in the lock release position and allows the locking pin 11 to move radially inwards.

The key 15 cannot be withdrawn from the keyway 16,18 unless the cam discs 5 are able to rotate relative to one another. Location of the locking pin 11 in the cam disc notches 14 prevents such relative rotation so withdrawal of the key 15 is possible only when the tumbler plates 6 are able to move back into the barrel lock position (FIGS. 4 and 5). If desired, two or more sets of locking recesses 10 may be provided in the cylinder body 4 to permit withdrawal of the key 15 at more than one rotational position of the barrel assembly 1. When the key 15 is withdrawn, the cam discs 5 are rotated and are thereby scrambled so that the locking pin 11 is unable to move toward the barrel release position.

A lock as shown in FIGS. 1 and 3 is arranged to permit removal of the barrel assembly 1 so that the combination can be altered by substitution of another barrel assembly 1. In the preferred form shown, that change - over of barrel assemblies 1 is effected by means of a special key as hereinafter described.

The barrel sleeve 2 and the adaptor 20 are preferably axially separable for the foregoing purpose. In the arrangement shown, the adaptor 20 is a generally cylindrical member which is rotatably mounted within the inner end portion of the cylinder body 4. A latch, deadbolt, or other actuator (not shown) may be attached to or formed integral with the end of the adaptor 20 remote from the lock keway entrance 21. The other end portion of the adaptor 20 is receivable within the adjacent end portion of the barrel sleeve 2 and drive means connects the sleeve 2 and adaptor 20 against relative rotation whilst permitting axial separation of those members. For example, as shown, drive dogs 22 on the adaptor 20 slidably located within axial extending slots 23 formed in the end portion of the sleeve 2.

Figure 9:
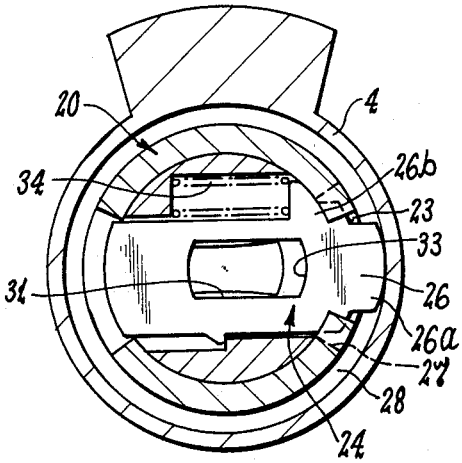
FIG. 9 is a transverse cross sectional view taken along line IX—IX of FIG. 3.

Retaining means is provided to releasably hold the sleeve 2 and adaptor 20 against axial separation and that can take any one of several forms. In the form shown, the retainer means includes a plate 24 which is arranged transverse to the barrel axis and is slidably mounted in a transverse passage 25 of the adaptor 20 for relative radial movement (FIGS. 1 and 9). The retainer plate 24 is movable between operative and inoperative positions (FIGS. 9 and 11 respectively) and may be spring biased towards the former. In the operative position (FIG. 9), the retainer plate 24 coacts with the sleeve 2 to prevent axial movement of that sleeve 2 out of the cylinder body 4. In the inoperative position (FIG. 11) however, there is no such coaction.

According to the embodiment shown, the retainer plate 24 has a nose portion 26 which projects laterally beyond one side of the adaptor 20, through a circumferential slot 27 in the wall of the sleeve 2 and into a circumferential groove 28 provided within the bore 3 of the cylinder body 4. The nose portion 26 is preferably stepped, so that, in the operative position, a relatively narrow section **26*a* locates within the cylinder groove 28 and a relatively wide section 26*b* locates within the circumferential slot 27 of the sleeve 2. One of the slots 23 forms a gate opening which extends from the circumferential slot 27 to the adjacent end of the sleeve 2 and, as shown in FIGS. 1 and 2, has a width such as to slidably receive the narrow section 26*a*, but not the wide section 26*b* of the plate nose portion 26**.

Figure 11:
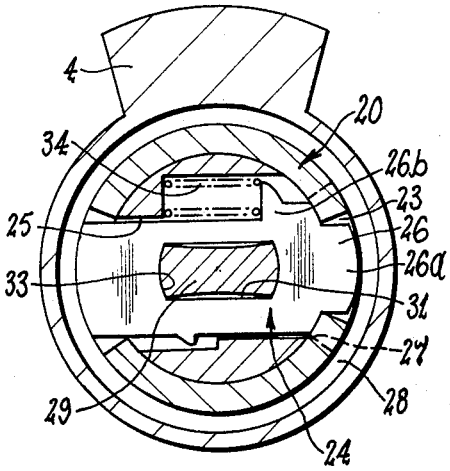
FIG. 11 is a view similar to FIG. 9 but showing the retainer plate released by a key of FIG. 10.

With the foregoing arrangement, when the retainer plate 24 is moved into the inoperative position as shown in FIG. 11, the wide section **26*b* is cleared from the sleeve circumferential slot 27 and the narrow section 26*a* is aligned with the gate opening 23. The sleeve 2 can then be separated from the adaptor 20, providing the tumbler plates 6 are not located within the locking recesses 10 of the cylinder body 4**.

Figure 10:
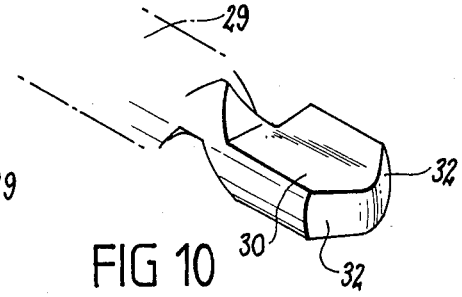
FIG. 10 is a perspective view of the end of a special change key for use with the lock of FIG. 1.

Movement of the retainer plate 24 into the inoperative position is preferably effected through a special change key 29 (FIG. 10) having a terminal end portion 30 which coacts with the retainer plate 24 to cause that movement. In the example shown, the retainer plate 24 has an opening 31 into which the terminal end portion 30 can project and a camming surface 32 of the terminal end portion 30 engages a surface 33 of the opening 31 to move the retainer plate 24 into the inoperative position against the action of the biasing spring 34. The normal key 15 however, has an end portion 19 which does not project into the retainer plate opening 31, or at least does not coact with that opening 31 in the foregoing manner.

When it is desired to remove the barrel assembly 1, the change key 29 is fully inserted to the position at which the retainer plate 24 is rendered inoperative. In the process, the cam discs 5 are moved into their respective lock release positions and consequently the barrel assembly 1 can be rotated to a position at which the tumbler plates 6 are clear of the locking recesses 10. At that position, the barrel assembly 1 can be moved axially out of the cylinder body 4 by applying an axially outward force to the key 15.

Insertion of the barrel assembly 1 may be facilitated by providing a chamfer 35 (FIG. 3) on the rear edge of each locking lobe 8. That is, the edge which faces towards the rear or inner end of the lock body 4. The rear edge 36 of each locking recess 10 may be similarly chamfered so that the barrel assembly 1 can be moved axially inwards while the locking lobes 8 and locking recesses 10 are longitudinally aligned.

The security of a lock as described can be improved by providing a hardened guard at the front outer end of the barrel assembly 1. In the example shown, a hardened annular member 37 is secured to the front end of the sleeve 2 by a cap member 38 swaged or otherwise connected to that end of the sleeve 2. The hardened member 37 guards against drilling to remove the locking pin 11, and in that respect has a portion overlying or in alignment with the adjacent end of the pin 11. Improper removal of the cap member 38 may be resisted by the manner of swaging of the cap member 38. In the arrangement shown in FIG. 3, a radially inner boss portion 39 of the cap member 38 projects through the annular guard member 37 and is expanded at its terminal end 40 to locate against a frusto-conical surface 41 of the guard member 37. Furthermore, the locking pin 11 may have a head 42 which prevents its axial withdrawal through the outer or front end of the assembly.

The lock particularly described can be modified in many ways without departing from the basic inventive concept. For example, the retainer plate 24 may locate beyond the rear end of the cylinder body 4 rather than within a circumferential groove 28 of the cylinder body 4. Also, the facility for front end removal of the barrel assembly 1 need not be adopted and one such an arrangement is shown in FIG. 12.

Figure 12:
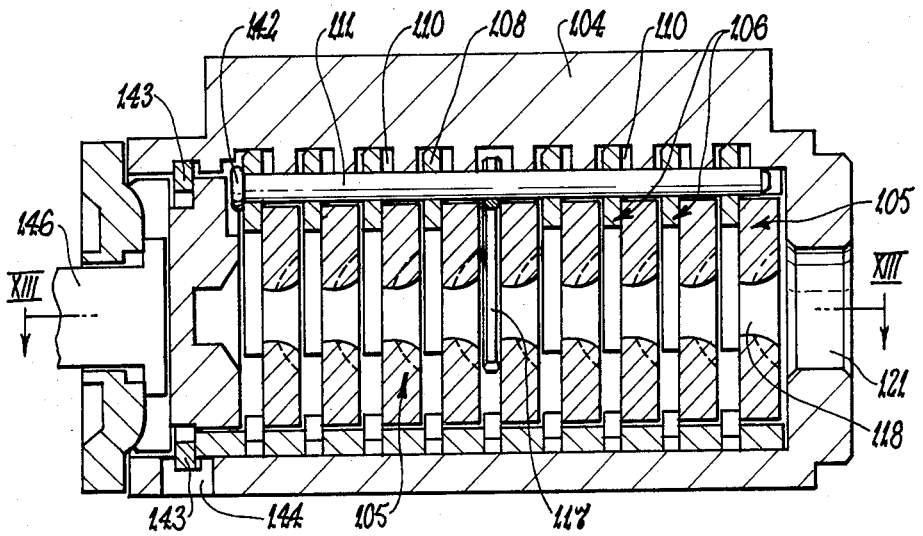
FIG. 12 is a view similar to FIG. 3 but showing another embodiment of the invention.
Figure 13:
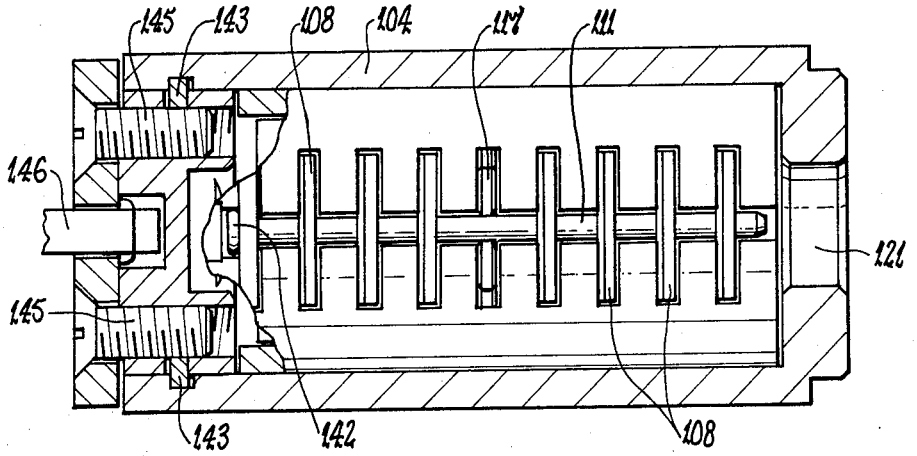
FIG. 13 is a cross sectional view taken along line XIII—XIII of FIG. 12.

In FIG. 12, components corresponding to those of the FIG. 3 construction will be given like references except that they will be in the number series 100–199. According to the FIG. 12 arrangement, a circlip 143 retains the barrel assembly 101 and cylinder body 104 against axial separation and access to that circlip 143 may be possible only through a plurality of holes 144 provided at the inner end of the lock body 104. As shown in FIG. 13, screws 145 which connect the latch or other actuator 146 to the barrel assembly 101 may coact with the circlip 143 to prevent its release while those screws 145 are in place.

Still further, in any embodiment, each cam disc may have a plurality of peripheral notches to provide for master keying and/or to inhibit picking of the lock.

A lock as described has many significant advantages. The use of tumbler plates which locate within individual locking recesses increases the resistance to forced axial separation of the barrel assembly from the cylinder body. The fully rotational cam discs inhibit picking of the lock as well as forced rotation of the barrel assembly. Also, removal or destruction of the locking pin is difficult to achieve. The lock is therefore very secure and that security is achieved in a relative simple construction. Furthermore, the lock can be made relatively small and can have a large number of key codes.

Various alterations, modifications and/or additions may be introduced into the constructions and arrangements of parts previously described without departing from the spirit or ambit of the invention as defined by the appended claims.

Having now described our invention, what we claim as new and desire to secure by Letters Patent is:

1. A cylinder lock including:

a body having a cylindrical bore therein, a barrel mounted within the bore for rotation relative to the body and thus having a rotational axis, a plurality of tumbler plates carried by the barrel so as to rotate therewith, each being arranged generally traverse to the rotational axis of said barrel, a plurality of locking recesses formed in a surface of said bore and axially spaced apart along the bore, each tumbler plate being movable laterally relative to the barrel to adopt either a barrel-lock position or a barrel-release position, a peripheral portion of each tumbler plate engaging within a respective locking recess when the plates are in the barrel-lock position to hold said barrel against rotation relative to said body and also to hold the barrel against axial separation from the body in at least one direction, control means operable to adopt either an operative condition or an inoperative condition in which it prevents and allows, respectively, movement of said tumbler plates out of said barrel-lock position, the control means including a locking pin which extends axially along said barrel and interconnects the tumbler plates so that they move in unison between the barrel-lock and release positions, key-responsive means interacting with the pin so as to prevent or allow lateral movement thereof towards said barrel-release position according to whether said control means is in the operative or inoperative condition, respectively, the barrel including a cylindrical sleeve, and the key-responsive means including a plurality of discs rotatably mounted within the sleeve, each disc having a particular rotational position relative to said sleeve at which it allows movement of said locking pin towards the barrel-release position, an opening through each disc arranged to receive and cooperate with a key so as to permit adoption of the particular rotational position, the sleeve having a plurality of circumferentially-extending slots formed through a wall thereof, each tumbler plate having the body part contained within said sleeve and the peripheral portion thereof being a lobe which projects laterally from the body part and slidably locates within a respective slot in both said barrel-lock and release positions, said tumbler plates and said discs being alternately located in face-to-face relationship along the axis of said barrel, and the body part of each tumbler plate having an opening therethrough to allow passage of a key.

2. A cylinder lock including:

a body having a cylindrical bore therein, a barrel mounted within said bore for rotation relative to said body and including a cylindrical sleeve, a plurality of tumbler plates carried by said barrel so as to rotate therewith and each being arranged generally transverse to the rotational axis of said barrel, a plurality of locking recesses formed in a surfaces of said bore, each said tumbler plate being movable laterally relative to said barrel to adopt either a barrel-lock position or a barrel-release position, and a peripheral portion of at least two of said tumbler plates engaging within a respective one of said locking recesses when those plates are in the barrel-lock position to hold said barrel against rotation relative to said body and also to hold said barrel against axial separation from said body in at least one direction, a locking pin which extends in the axial direction of said barrel and interconnects said tumbler plates so that they move in unison between said barrel-lock and barrel-release positions, a plurality of discs rotatably mounted within said barrel sleeve, each having a particular rotational position relative to said sleeve at which it allows movement of said locking pin and said tumbler plates towards said barrel-release position, each said disc being operative when not in said particular rotational position thereof to interact with said pin and thereby prevent said movement into said barrel-release position, a plurality of circumferentially-extending slots formed through a wall of said barrel sleeve, each said tumbler plate having a body part contained within said sleeve, the peripheral portion thereof being a lobe which projects laterally from said body part and slidably locates within a respective said slot in both said barrel-lock and barrel-release positions, said tumbler plates and said discs being alternately located in face-to-face relationship along the axis of said body, an opening existing through each said disc and the body part of each said tumbler plate so that a key can be passed through said discs and tumbler plates, and each said disc opening being arranged to cooperate with the key so that the discs are responsive to passage of said key to adopt said particular rotational positions thereof.

3. A lock according to claim 2, wherein said recesses are spaced apart in the axial direction of said bore and said peripheral portion of each tumbler plate is engagable within a respective one of said recesses.

4. A lock according to claim 2, wherein spring means resiliently urges said tumbler plates towards said barrel lock position.

5. A cylinder lock according to claim 2, wherein the barrel is movable axially into an out of the body through an end of the bore.

6. A lock according to claim 5 comprising retainer means to hold the barrel against axial separation when the tumbler plates are in the barrel-release position.

7. A lock according to claim 6, wherein the retainer means includes a spring circlip which interacts between said barrel and said body and is located at a rear end portion of said body, and releasable means is provided at said rear end portion to prevent release of said circlip from operative interconnection with both said barrel and said body.

8. A lock according to claim 7, wherein said releasable means includes at least one screw which projects into said rear end portion and which also serves to secure an actuator to said barrel.

9. A lock according to claim 7, wherein said circlip is accessible for release through a plurality of holes formed through said body rear end portion.

10. A lock according to claim 6, wherein said bore end is located at a front end of said body, said retainer means includes a member which is connected to the barrel and projects laterally relative thereto to engage an opposed surface and thereby prevent said axial separation, said retainer member is mounted for movement relative to said barrel so as to be movable into an inoperative position at which it does not engage said opposed surface, spring means resists movement of said retainer member into said inoperative position, and said retainer member is cooperable with a special key to be moved into said inoperative position.

11. A lock according to claim 2, wherein said discs are rotatable about the axis of said sleeve and that axis passes through each said disc opening.

12. A lock according to claim 2, wherein each said disc has a notch in the periphery thereof and said locking pin is located within each said notch when said tumbler plates are in the barrel release position.

13. A lock according to claim 2, wherein said discs are freely rotatable relative to said sleeve.

14. A lock according to claim 2, wherein a hardened guard is provided over a front of said lock to prevent access to said locking pin.

* * * * *